US005346001A

United States Patent [19]

Rieke et al.

[11] Patent Number: 5,346,001

[45] Date of Patent: Sep. 13, 1994

[54] PRIMARY HEAT EXCHANGER HAVING IMPROVED HEAT TRANSFER AND CONDENSATE DRAINAGE

[75] Inventors: Larry D. Rieke, Zionsville; Timothy J. Waterman, Carmel, both of Ind.

[73] Assignee: Carrier Corporation, Syracuse, N.Y.

[21] Appl. No.: 88,440

[22] Filed: Jul. 7, 1993

[51] Int. Cl.[5] ..... F28F 3/12

[52] U.S. Cl. ..... 165/170; 126/110 R; 126/116 R

[58] Field of Search ..... 165/170, 165; 126/99 R, 126/110 R, 116 R

[56] References Cited

U.S. PATENT DOCUMENTS 3,399,661 9/1968 Kreis ..... 126/116 R
4,467,780 8/1984 Ripka ..... 126/110 R
4,739,746 4/1988 Tomlinson ..... 126/110 R
4,982,785 1/1991 Tomlinson ..... 165/170
5,062,409 11/1991 Kamanaka et al. ..... 126/99 R
5,094,224 3/1992 Diesch ..... 126/99 R X
5,271,376 12/1993 Lu et al. ..... 126/110 R

*Primary Examiner*—John Rivell
*Assistant Examiner*—L. R. Leo

[57] ABSTRACT

In a multi-poise furnace having multiple parallel heat transfer stages, each stage having superimposed flow passages lying in a common plane. The last passage in each stage containing laterally-disposed indentations in opposed side walls for increasing the heat transfer surface area, and the walls of the last passage being further configured to conduct any condensate formed in the heat exchanger out of the exit region of the exchanger, regardless of the furnace orientation.

17 Claims, 6 Drawing Sheets

PRIMARY HEAT EXCHANGER HAVING IMPROVED HEAT TRANSFER AND CONDENSATE DRAINAGE

BACKGROUND OF THE INVENTION

This invention relates to a primary heat exchanger for use in a multi-poise condensing furnace.

The term multi-poise furnace, as herein used, refers to a furnace that can be orientated so that conditioned return air leaving the furnace may be discharged in either an upward or a downward direction as well as horizontally both to the right and to the left without performing any major modification to the component parts of the unit. Some furnaces are available that allow the unit to be installed in different positions, however, for the most part, these units require extensive modifications to achieve the desired orientation.

Many multi-poise furnaces are equipped with air conditioning units. As a result, condensate can be formed in the primary heat exchanger region due to cool conditioned air being passed over the heat exchanger during the warm months when air conditioning is called for. Similarly, oversizing of the furnace by an installer will result in short on-periods during heating cycles. This does not allow the heat exchanger surface to become sufficiently heated to entirely eliminate condensate that might be present in this area. Underfiring, wherein the gas rate provided to the furnace is lower than the acceptable design rate, can produce the same undesirable result. Slight misalignment of the furnace during installation may also allow condensate to collect in the heat exchanger region. Any condensate collecting in this region can adversely effect the furnace performance and can cause corrosion problems leading to early furnace failure.

It should also be noted that multi-poised furnaces are oftentimes selected for use in applications where available furnace space is limited. The size of a multi-poise unit, to a large extent, is determined by the amount of space required by the primary heat exchanger. Any saving in this regard without sacrificing furnace performance is highly desirous.

SUMMARY OF THE INVENTION

It is an object of the present invention to improve multi-poise furnaces.

A further object of the present invention is to reduce the amount of space utilized by the primary heat exchanger of a multi-poise condensing furnace without sacrificing performance.

A still further object of the present invention is to prevent condensate from collecting in the primary heat exchanger of a multi-poise condensing furnace which might occur because of alignment errors or the like.

Another object of the present invention is to reduce the number of passes required by the primary heat exchanger of a multi-poise furnace.

Yet another object of the present invention is to provide a primary heat exchanger for use in a multi-poise condensing furnace that will drain unwanted condensate therefrom, regardless of the furnace orientation.

Still another object of the present invention is to provide a primary heat exchanger stage for a multi-poise condensing furnace that is stamped from a single sheet of material.

While another object of the present invention is to provide drainage for the primary heat exchanger of a multi-poise furnace which is capable of removing condensate when the furnace is operating in an air conditioning or cooling mode.

These and other objects of the present invention are attained by a primary heat exchanger that is suitable for use in a multi-poised furnace. The heat exchanger contains multiple parallel stages. Each stage, in turn, includes a housing that contains a series of superimposed, interconnected, horizontally-disposed flow passages for conducting flue gas products from an entrance in the upper-most first pass to an exit in the lower-most last pass. The flow passage wall of the last pass in the series converges toward the exit and is configured to direct any unwanted condensate that might collect in this region to the exit. The flow passage last pass in the series also contains vertically-disposed indentations or beads formed alternately in the opposing side walls thereof which extend partially up the walls from the bottom wall toward the top wall of the flow passage to provide an unrestricted flow path adjacent the top wall of the passage and a restricted flow path therebelow. The beads serve to increase the heat transfer surface area of the heat exchanger and also force the flue gas to travel a greater distance over and around the beads. This, in turn, increases the flue gas velocity and results in an increase in the amount of energy exchanged between the flue gas and the comfort air.

BRIEF DESCRIPTION OF THE DRAWINGS

For a better understanding of these and other objects of the present invention, reference will be made herein to the following detailed description which is to be read in association with the accompanying drawings.

DESCRIPTION OF THE INVENTION

Figure 1:
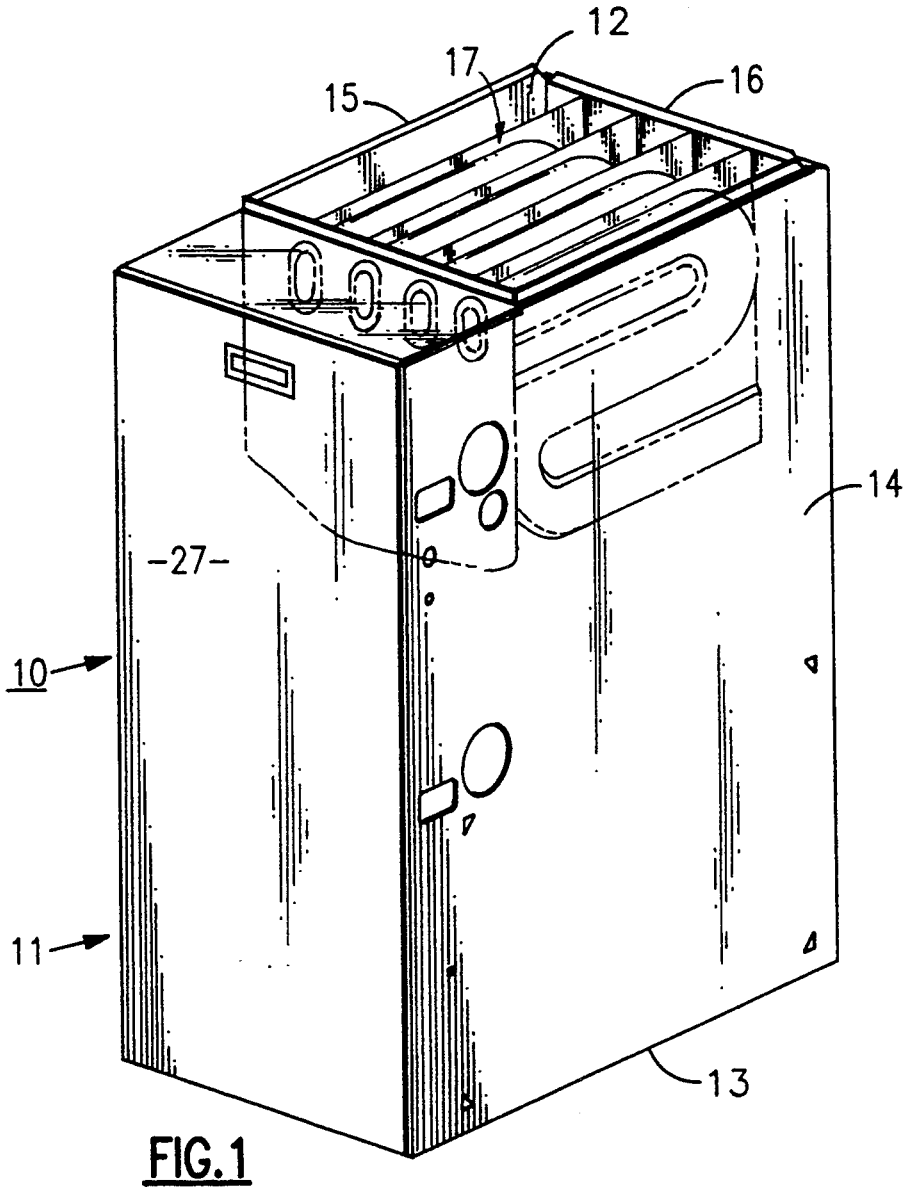
FIG. 1 is a perspective view of a multi-poise furnace, with the top panel removed, showing the location of the primary heat exchanger embodying the teachings of the present invention.
Figure 11:
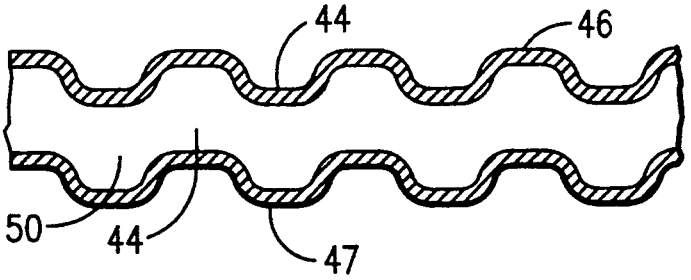
FIG. 11 is an enlarged, partial sectional view taken along lines 11—11 in FIG. 7.
Figure 2:
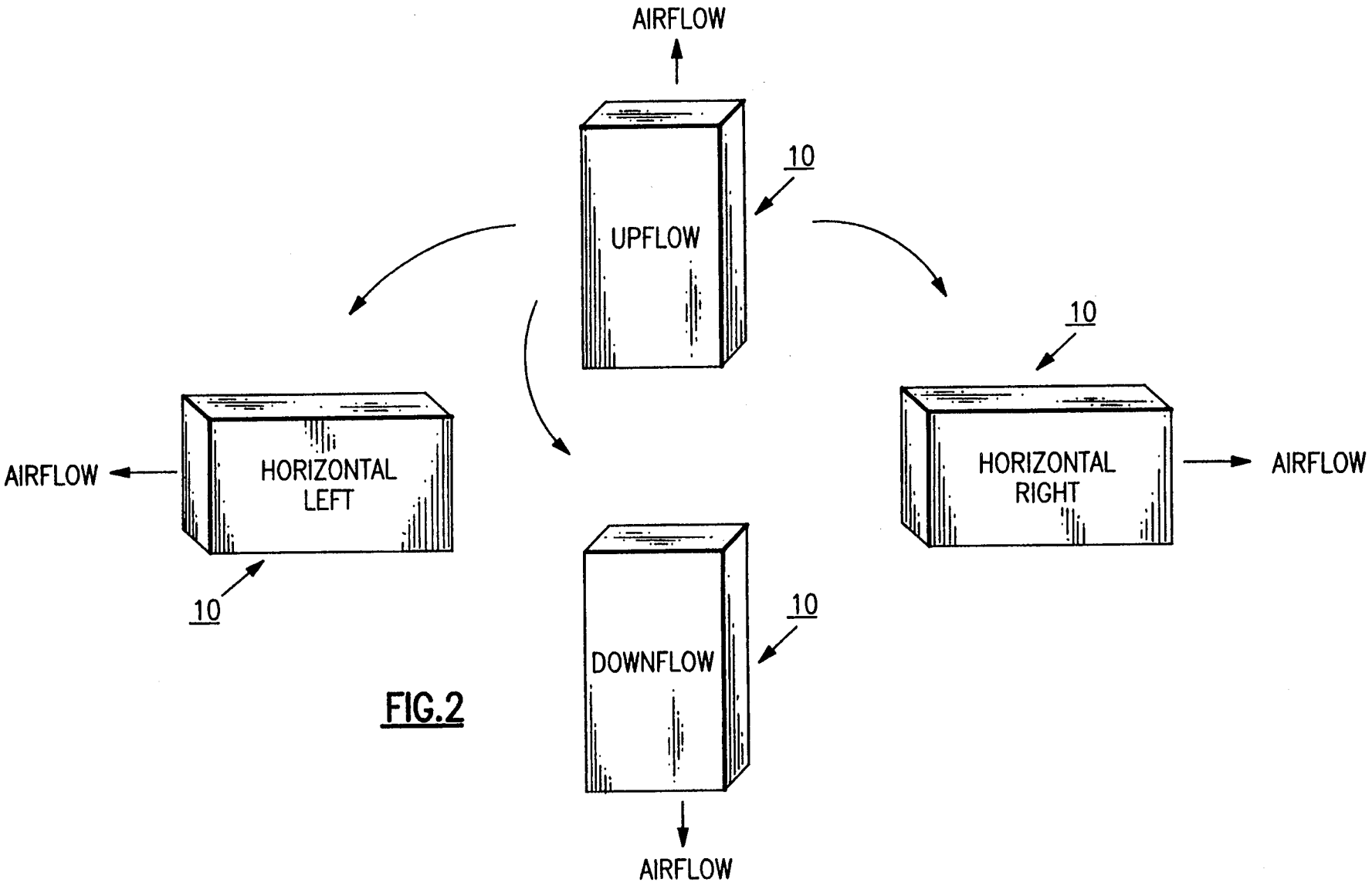
FIG. 2 is a diagrammatic view showing the present furnace orientated in various operable positions.
Figure 3:
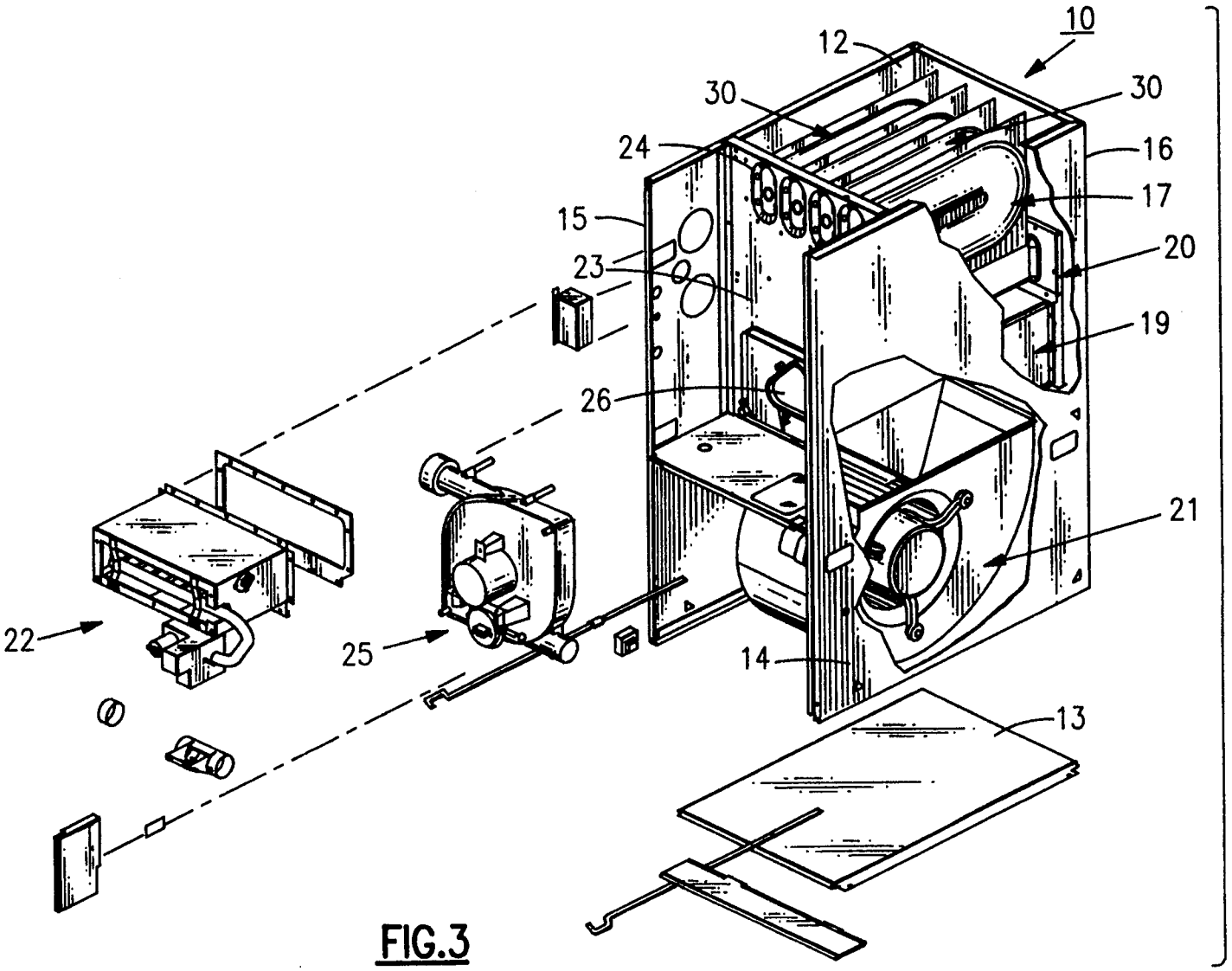
FIG. 3 is an exploded view showing the major components of the present furnace.
Figure 4:
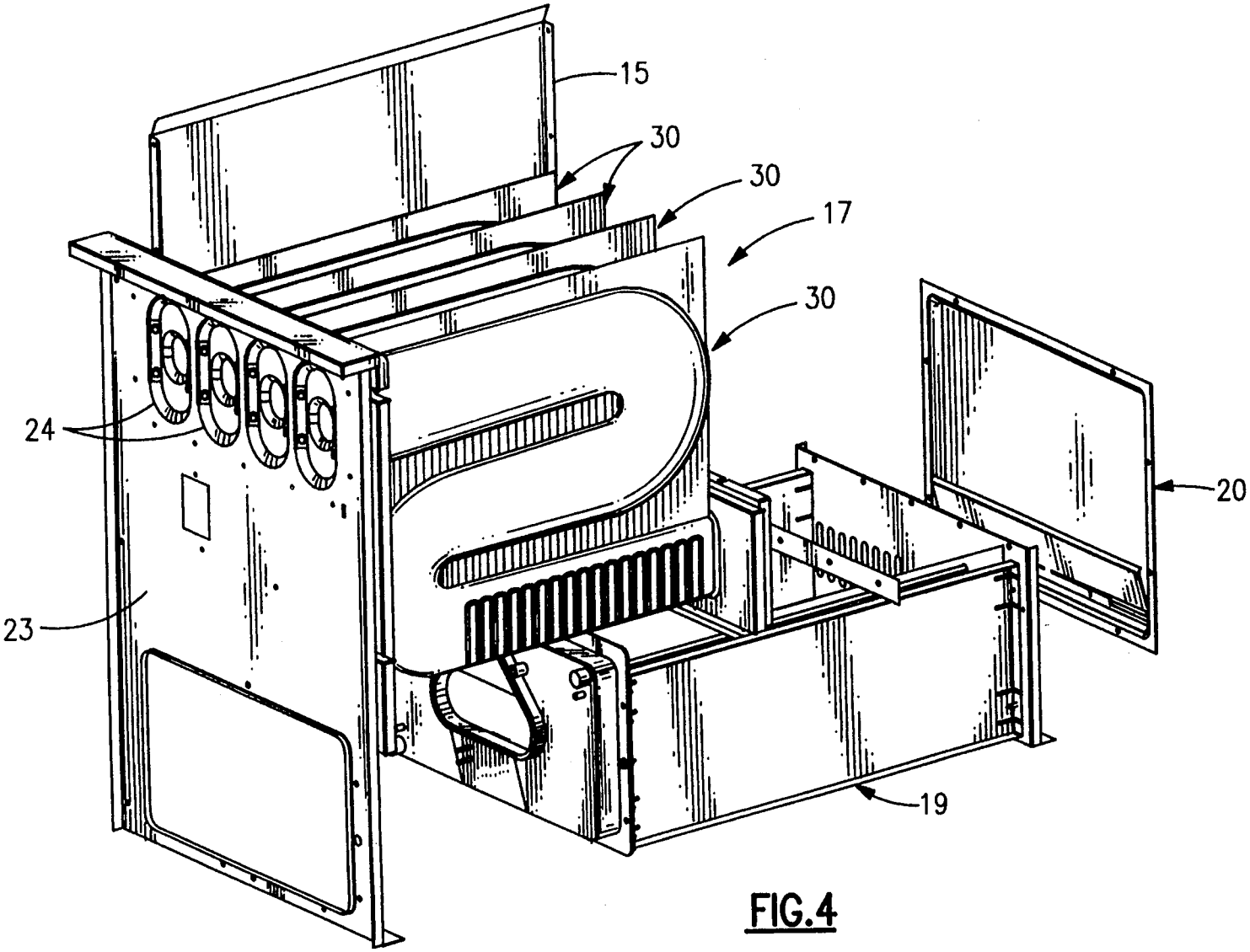
FIG. 4 is an enlarged exploded view in perspective showing the heat exchangers employed in the present furnace.
Figure 6:
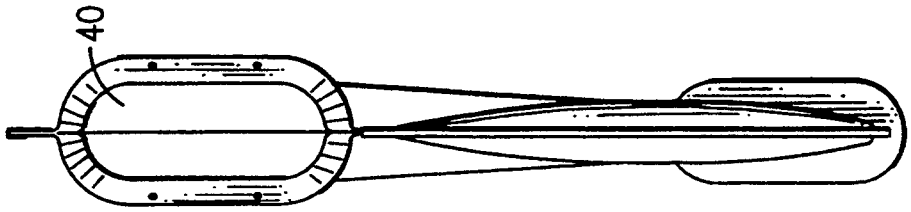
FIG. 6 is a left end view of the heat exchanger stage shown in FIG. 5.

Referring initially to FIGS. 1–3, there is depicted a multi-poise condensing furnace, generally referenced 10, that is housed within a compact, rectangular-shaped enclosure 11. The furnace is shown in an upflow orientation wherein return air from a comfort zone is drawn into the furnace through a bottom opening and passed upwardly through return air duct 12 and discharged via an opening in the top wall of the unit.

Although not shown, the furnace is configured so that a return air entrance can be selectively located in the bottom wall 13 of the housing or in either one of the two side walls 14 and 15. A primary heat exchanger 17, embodying the teaching of the present invention, is mounted in the supply air duct at the top of the furnace adjacent to the top wall opening.

The terms top and bottom, and other relative terms used herein, describe various components or regions of the furnace when the unit is placed in an upflow orientation as shown in FIG. 1. It should be clear, however, that the furnace can be placed in a number of different orientations as illustrated in FIG. 2. These include the upflow orientation illustrated in FIG. 1 wherein the supply air is discharged from the furnace in an upward direction and a downflow orientation wherein the furnace is inverted to discharge the supply air in a downward direction. In addition, the furnace may also be tipped ninety degrees out of the upflow orientation to provide either a horizontal left or a horizontal right supply air discharge. The primary heat exchanger, along with other component parts of the furnace must operate effectively in any of the above-noted orientations. Although the present furnace is designed to prevent condensate from developing in the primary heat exchanger section, condensate may collect in this area for any of the reasons noted above, or other reasons beyond the control of the manufacturer. As will be explained in greater detail below, the primary heat exchanger is able to handle any unwanted condensate that is formed therein, regardless of the furnace orientation. In addition, the heat transfer surface area of the present heat exchanger has been considerably increased, thus making it possible to reduce the number of passes required to transfer energy into the supply air flow.

The major operational components of the furnace are shown in the exploded view of FIG. 3. They include, in addition to the primary heat exchanger 17, a secondary condensing heat exchanger 19 connected to the primary heat exchanger by a flue gas manifold. The manifold conducts flue gas products from the outlet of the primary unit to the inlet of the secondary unit. A return air fan 21 is mounted in the bottom of the furnace and forces return air drawn from a comfort zone through the return air duct 12 whereby the return air is passed sequentially over the heat transfer surfaces of the secondary unit and then over the heat transfer surfaces of the primary unit. A burner assembly 22 is attached to the vertical interior panel 23 in front of the entry ports 24 to each of the parallel primary heat exchanger stages 30—30. The burner assembly contains a separate burner for servicing each stage which is adapted to inject high temperature flue gas products directly into the entrance of an associated heat exchanger stage.

An inducer unit 25 is also secured to the vertical panel 23 and is operatively attached to a collector box 28 attached to the discharge side of the secondary heat exchanger. The inducer functions to pull flue gas products through the two heat exchangers and discharge the products to one or the other side of the furnace, depending upon the furnace's orientation. A removable front panel 27 is used to enclose the burner assembly, the inducer and return air fan.

Although the primary heat exchanger shown in the drawings contains four parallel stages 30—30 that are vertically aligned in spaced apart relationship within the supply air duct, it should be clear to one skilled in the art that more or less stages may be employed without departing from the teachings of the present invention. The supply air passing through the duct is forced over the heat transfer surfaces of each stage.

Figure 5:
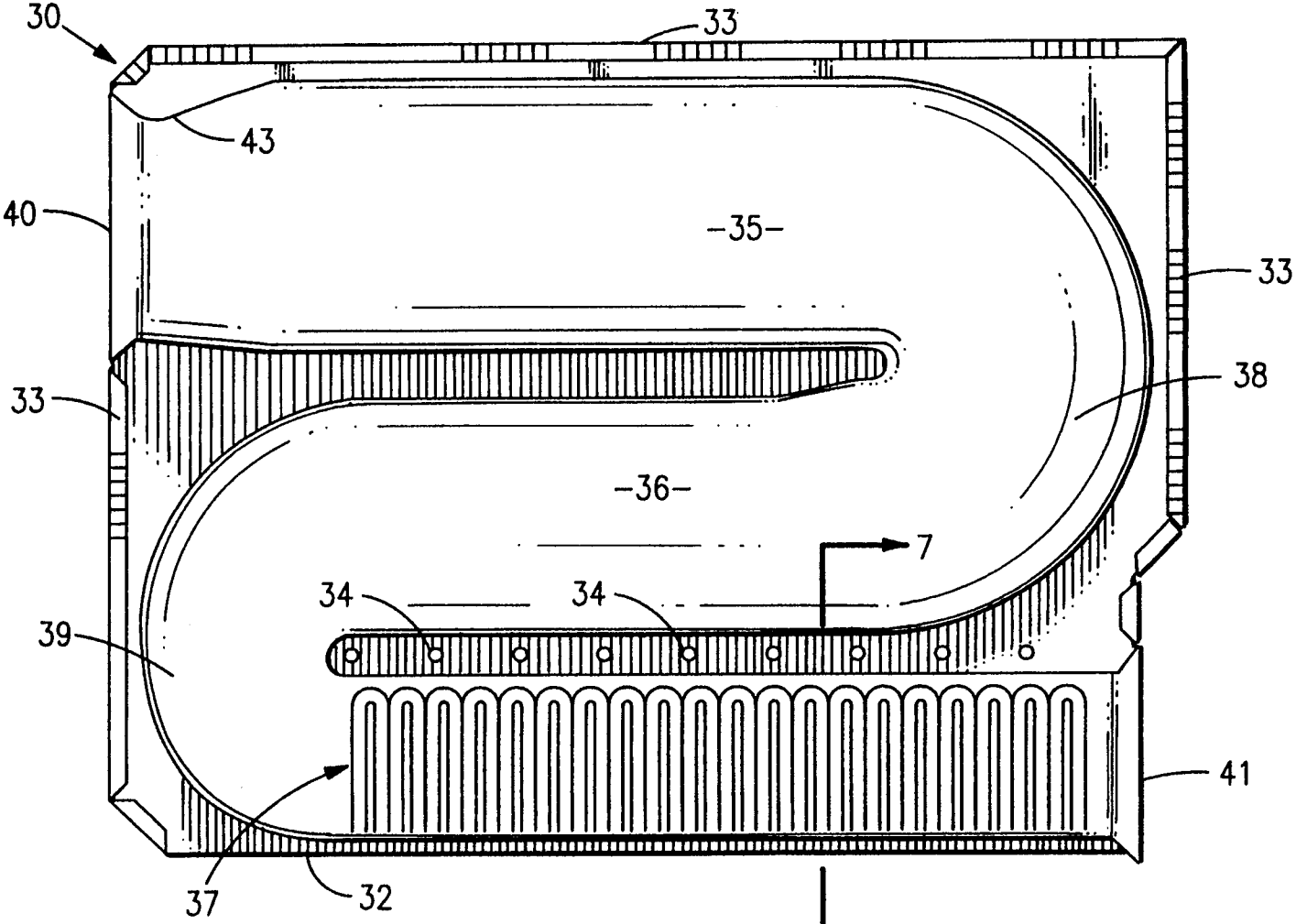
FIG. 5 is a further enlarged side elevation of a primary heat exchanger stage embodying the teachings of the present invention.

Each primary heat exchanger stage is stamped as two half-sections from a single sheet metal plate. The half-sections are arranged to close one against the other in face-to-face contact about a common bendline that extends axially along the bottom edge 32 of the stage (FIG. 5). The contacting peripheral edges of the two sections form an apron surrounding the flow passages and are bent over and crimped to create leak tight seams 33—33 about the seam edges. The metal in other contact areas can also be deformed by punching 34—34, or the like, to form mechanical joints between the sections to further enhance closing of the sections. Spot weld may also be used in the contact regions to securely hold the sections in intimate contact.

The individual heat exchanger sections each utilize three heat transfer passes, which is one less than found in most comparable furnaces found in the prior art. As will be explained in greater detail below, the present heat exchanger provides a considerable savings in space without sacrificing heating efficiency.

The present heat exchanger passes include an upper entrance pass 35, an intermediate pass 36 and a lower exit pass 37. The three passes are superimposed in a common vertical plane and are connected as shown by two 180° bend sections 38 and 39 to provide a continuous flow path between an upper entrance 40 and a lower exit 41. As noted, a burner is situated adjacent to the entrance of each stage and is arranged to inject hot flue gas products directly through the entrance region. A necked down throat 43 is located at the entrance to each stage for holding the flue gases within the passage of the first pass. The flow passages in the first and second passes diverge or narrow down in the direction of flow. The bend section also diverges in the same manner so that the velocity of the flow within the flow passage increases as the flue gases give up energy to the return area. This, in turn, holds the sensible heat at a high enough level whereby condensate is prevented from forming in the three passes.

The flow passage of the last pass 37 is described by a top wall 52, a bottom wall 53 and two opposed side walls 46 and 47. The side walls further include a series of laterally-disposed indentations 44 that extend upwardly from the bottom wall of the flow passage toward the top wall As best seen in FIGS. 7–11, the indentations are alternately stamped in the opposing side walls to provide a tortuous restricted path of travel 50 (FIG. 11) through which flue gas products in the lower section of the passage are forced to travel. An unrestricted flow channel 51 is established in the top part of the flow section adjacent to the top wall thereof.

Figure 7:
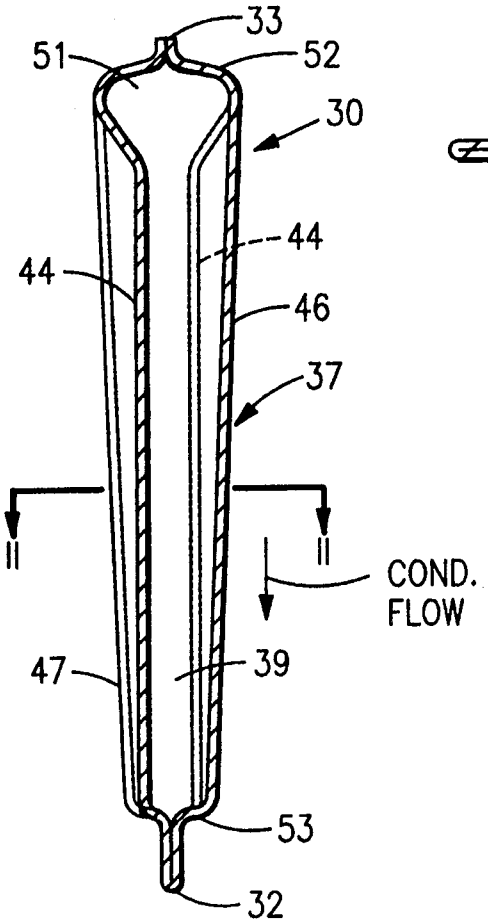
FIG. 7 is an enlarged sectional view taken along lines 7—7 in FIG. 5 showing orientation of the last pass of the primary heat exchanger when the furnace is in an upflow position.

The opposing side walls of the last pass flow passage converge upwardly from the bottom of the flow passage toward the top wall. Similarly, the top and bottom walls of the flow passage converge toward the heat exchanger exit region. FIG. 7 illustrates a typical cross-section through the last pass of the exchanger when the furnace is placed in an upflow orientation (FIG. 2). As can be seen, any condensate that might be formed in this region will be directed by the side wall to the bottom of the passage and then conducted by the bottom wall through the exit region into the flue gas manifold. The manifold, in turn, is adapted to conduct the condensate into the downstream, secondary condensing heat exchanger which is specifically designed to handle condensate of this nature.

Figure 8:
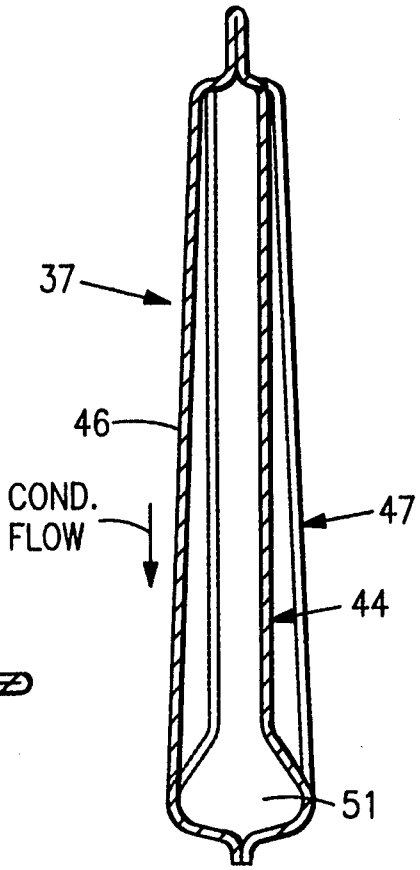
FIGS. 8–10 are also sectional views similar to FIG. 7 showing the last pass of the primary heat exchanger when the furnace is orientated in various operable positions.

FIG. 8 illustrates the position of the last pass when the furnace is inverted, or placed in a down-flow orientation. Here again, condensate formed in the restricted region of the flow passage is collected in the unrestricted flow channel 51 and again conducted along the top wall 52 into the flue gas manifold.

Figure 9:
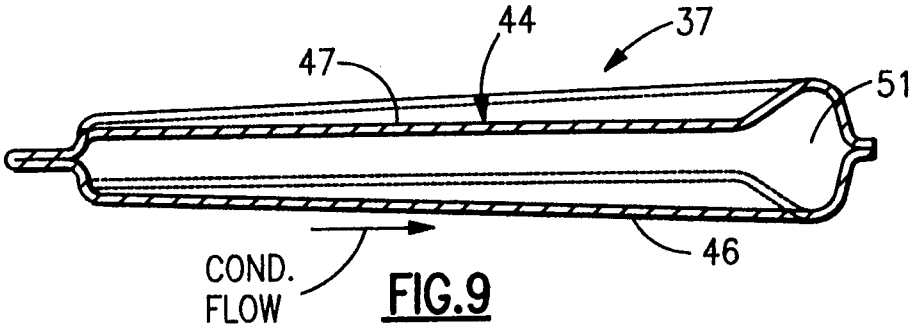
Figure 10:
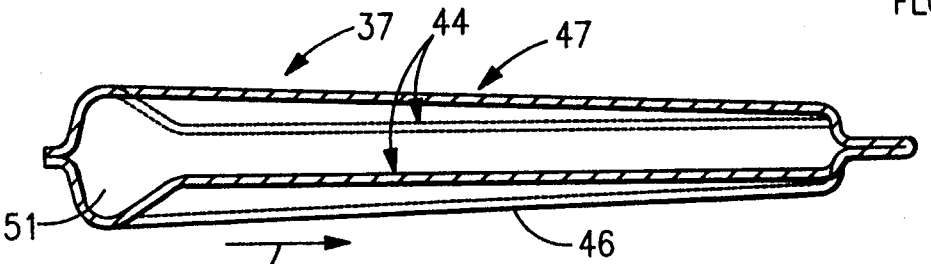

FIGS. 9 and 10 show the position of the last pass of the primary heat exchanger when the furnace is orientated in horizontal right and left discharge positions, respectively. Again, it is evident that condensate formed in the last pass is directed by the side walls of the passage into the unrestricted flow region 51. Here again, the condensate flows by gravity into the downstream manifold.

As should be evident from the disclosure above, the primary heat exchanger of the present invention provides certain advantages over similar devices found in the prior art. First the parallel stages of the unit are configured so that unwanted condensate is conducted in the direction of the flue gas flow into the flue gas manifold, despite the furnaces orientation. Secondly, the last pass in each stage is provided with corrugated side walls that run perpendicular to the gas flow. This increases the heat transfer surface area of the last pass and eliminates the need for further passes resulting in the saving of space without adversely affecting furnace performance.

While this invention has been explained with reference to the structure disclosed herein, it is not confined to the details set forth and this invention is intended to cover any modifications and changes as may come within the scope of the following claims:

What is claimed is

1. In a multi-poise furnace, a primary heat transfer stage for exchanging energy between internal heated flue gases and external comfort air, said stage including a series of interconnected flow passages that are superimposed in a plane for conducting flue gases between an entrance region in the first flow passage and an exit region in the last flow passage in said series, said last flow passage in the series containing top and bottom walls and opposed side walls having laterally- disposed indentations formed thereon that extend from the bottom wall partially up said side walls to establish a restricted flow path in the bottom section of said last flow passage and an unrestricted flow path in the top section of said last flow passage adjacent the top wall for increasing the heat transfer surface area of said last passage.

2. The heat exchanger stage of claim 1 wherein the indentations formed in said side walls are alternately spaced along the opposed side walls.

3. The heat exchanger stage of claim 1 wherein each flow passage is connected to the next succeeding flow passage by a 180° arcuate-shaped bend section.

4. The heat exchanger stage of claim 1 wherein the entrance to the heat exchanger includes a restricted necked down section.

5. The heat exchanger stage of claim 1 wherein the side walls of said last flow passage converge from the bottom wall toward the top wall.

6. The heat exchanger stage of claim 5 wherein the top and bottom walls of said last flow passage converge toward the exit region.

7. The heat exchanger stage of claim 6 wherein said stage has an apron lying in said plane that extends about the periphery of said stage and joint means for securing the half-sections along contacting peripheral edges of said half-sections.

8. The heat exchanger stage of claim 7 wherein said apron extends between adjacent flow passages.

9. The heat exchanger stage of claim 1 wherein said stage is stamped from a single piece of sheet metal in two half-sections about a common bendline that extends axially along the bottom wall whereby the half-sections are bendable about said bendline into closing contact against each other.

10. The heat exchanger of claim 1 wherein said stage contains three flow passages.

11. A primary heat exchanger for use in a multi-poised furnace that includes a housing having a supply air duct through which return air is passed, a series of parallel heat transfer stages mounted in spaced-apart relationship within said supply air duct, each stage having interconnected flow passages that are superimposed in a plane for conducting flue gases between an entrance region in said first flow passage and an exit region in the last flow passage of the stage, said last flow passage in each stage having top and bottom walls and two opposed side walls and further including laterally-disposed indentations in said opposed side walls that extend from the bottom wall partially up the side walls to establish a restricted flow path in the bottom section of said last flow passage and an unrestricted flow path in the top section of said last flow passage.

12. The heat exchanger of claim 11 wherein the side walls of said last flow passage in each stage converge from the bottom wall toward said top wall.

13. The heat exchanger of claim 12 wherein the top and bottom walls converge in the direction of flow of the last flow passage of each stage to conduct condensate into the exit region of said stage.

14. The heat exchanger of claim 13 wherein a burner means is mounted at the entrance region of each stage to direct high temperature flue gas products into each stage.

15. The heat exchanger of claim 14 wherein the exit region of each stage empties into a common manifold for conducting the flue gas products into a downstream secondary condensing heat exchanger.

16. The heat exchanger of claim 13 wherein each stage contains three flow passages that are interconnected by arcuate-shaped bend sections.

17. The heat exchanger of claim 16 wherein each stage is stamped from a single sheet of metal.

* * * * *